US008662298B2

(12) United States Patent
Aldana et al.

(10) Patent No.: US 8,662,298 B2
(45) Date of Patent: Mar. 4, 2014

(54) MAGNETIC EDGE CLOSURE COVER

(75) Inventors: Leonardo Aldana, Waterloo (CA); Felipe Oliveira Simoes, Kitchener (CA)

(73) Assignee: BlackBerry Limited, Waterloo, Ontario (CA)

( * ) Notice: Subject to any disclaimer, the term of this patent is extended or adjusted under 35 U.S.C. 154(b) by 0 days.

(21) Appl. No.: 13/404,326

(22) Filed: Feb. 24, 2012

(65) Prior Publication Data

US 2013/0219834 A1 Aug. 29, 2013

(51) Int. Cl.

| | |
|---|---|
| ***B65D 65/02*** | (2006.01) |
| ***B65D 51/00*** | (2006.01) |
| ***E05C 17/56*** | (2006.01) |

(52) U.S. Cl.

USPC ..... 206/320; 206/818; 220/230; 292/251.5

(58) Field of Classification Search

USPC ..... 206/305, 320, 818; 150/118, 165; 220/230; 229/79–84, 87.01–87.13, 229/92.1, 92.7, 92.8; 292/251.5

See application file for complete search history.

(56) References Cited

U.S. PATENT DOCUMENTS

| | | | | |
|---|---|---|---|---|
| 3,716,091 | A | 2/1973 | Gaines | |
| 3,827,019 | A * | 7/1974 | Serbu | 292/251.5 |
| D291,990 | S | 9/1987 | Lee | |
| 4,738,390 | A * | 4/1988 | Brennan | 206/818 |
| 5,135,012 | A * | 8/1992 | Kamen et al. | 220/230 |
| 5,704,480 | A * | 1/1998 | Scholz et al. | 206/818 |
| 7,318,521 | B2 * | 1/2008 | Lau | 206/320 |
| 7,409,058 | B2 | 8/2008 | Holmes et al. | |
| 7,568,566 | B2 * | 8/2009 | D'Ambrosio | 206/320 |
| D606,739 | S | 12/2009 | Fahrendorff et al. | |
| D637,393 | S | 5/2011 | Stampfli | |
| D638,218 | S | 5/2011 | Youssefi-Shams et al. | |
| 7,991,148 | B2 | 8/2011 | Holmes et al. | |
| 2005/0265574 | A1 | 12/2005 | Holmes et al. | |
| 2006/0183518 | A1 | 8/2006 | Emano | |
| 2007/0193902 | A1 * | 8/2007 | Myers et al. | 206/320 |
| 2008/0156833 | A1 | 7/2008 | Espiritu et al. | |
| 2009/0095751 | A1 | 4/2009 | Hamlin | |
| 2010/0288804 | A1 | 11/2010 | Youssefi-Shams et al. | |
| 2011/0261951 | A1 | 10/2011 | Holmes et al. | |

FOREIGN PATENT DOCUMENTS

| | | |
|---|---|---|
| DE | 29707519 | 7/1997 |
| FR | 2862948 | 6/2005 |
| GB | 2363159 | 12/2001 |

OTHER PUBLICATIONS

Extended European Search Report issued in European Application No. 12156975.0 on Aug. 9, 2012; 11 pages.

Sena MagnetFlipper Case for BlackBerry 8300 Curve, http://www.amazon.com/Sena-MagnetFlipper-Case-BlackBerry-Curve/dp/.../ref=sr_1_, Feb. 13, 2012 (4 pages).

(Continued)

*Primary Examiner* — Bryon Gehman

(74) *Attorney, Agent, or Firm* — Fish & Richardson P.C.

(57) ABSTRACT

A mobile electronic device cover has a first cover portion with a first edge surface along a perimeter thereof. A second cover portion has a second edge surface along a perimeter thereof. A magnetic clasp has a first part in the first portion of the cover adjacent the first edge surface and a second part in the second portion of the cover adjacent the second edge surface. The magnetic clasp is adapted to magnetically hold the first edge surface meeting the second edge surface.

22 Claims, 3 Drawing Sheets

(56) References Cited

OTHER PUBLICATIONS

Wireless Solutions Leather Cell Phone Holster (#22) for iPhone 3GS, iPhone 4; LG Chocolate Touch, Optimus S, Optimus T, Phoenix; Motorola Theory; Pantech Caper TXT8035, Pantech Laser P9050, Pantech Link P7040; Samsung Freeform III R380, Galaxy Prevail M820, Gravity Smart T589, Eternity II A597, http://www.amazon.com/Wireless-Solutions-Chocolate-Motorola-Freeform/dp/B003LM4, Feb. 14, 2012 (4 pages).

Sena Dockable Case for Apple iPhone 3G/3GS, http://www.amazon.com/Sena-Dockable-Case-Apple-iPhone/dp/B001F50UD6, Feb. 13, 2012 (7 pages).

Belkin Leather Flip Case for Apple iPhone 3G, 3GS, http://www.amazon.com/Belkin-Leather-Flip-Apple-iPhone/dp/B001B498F2/ref=sr__1__9?i, Feb. 14, 2012 (6 pages).

Samsung 1997 Infuse 4G Genuine Leather Flip Case, http://www.amazon.com/SAMSUNG-1997-INFUSE-Genuine-Leather/dp/B004W1IXGG/r, Feb. 14, 2012 (6 pages).

Nokia N8 Premium PU Leather Flip Case with 6 Screen Protectors and 1 Stylus, http://www.amazon.com/Premium-Leather-Screen-Protectors-Stylus/dp/B00477RWNK/re, Feb. 14, 2012 (6 pages).

Case-mate ID Credit Card Case for BlackBerry Tour 9630 & Bold 9650, Metallic Silver CM010206, http://www.amazon.com/Case-mate-Credit-BlackBerry-Metallic-CM010206/dp/B002Z8N, Feb. 14, 2012, (5 pages).

For Verizon AT&T iPhone 4 Vertical Flip Leather Pouch Case, http://www.amazon.com/Verizon-iPhone-Vertical-Leather-Pouch/dp/B0040UTBAQ/ref=sr__1__1?s=electronics&ie=UTF8&qid=1329255733&sr=1-1, Feb. 14, 2012 (4 pages).

* cited by examiner

MAGNETIC EDGE CLOSURE COVER

BACKGROUND

A mobile electronic device can be a cellular phone, including a smart phone, a dedicated personal digital assistant (PDA) with or without phone or data capabilities, an electronic reading device, a tablet computer, a digital media player, or any other mobile device. In many instances, the terms "mobile device," "hand held device" and "hand set" are interchangeable, both regarding to electronic devices available as information stores for personal contacts, calendar appointments, and the like. Since users often carry their mobile electronic devices with them throughout the day, the most popular covers for containing and protecting the devices are those that are compact and easy to use. Some covers have flaps that are retained closed with magnetic clasps, having one or more magnets.

DESCRIPTION OF DRAWINGS

Like reference symbols in the various drawings indicate like elements.

DETAILED DESCRIPTION

Figure 1A:
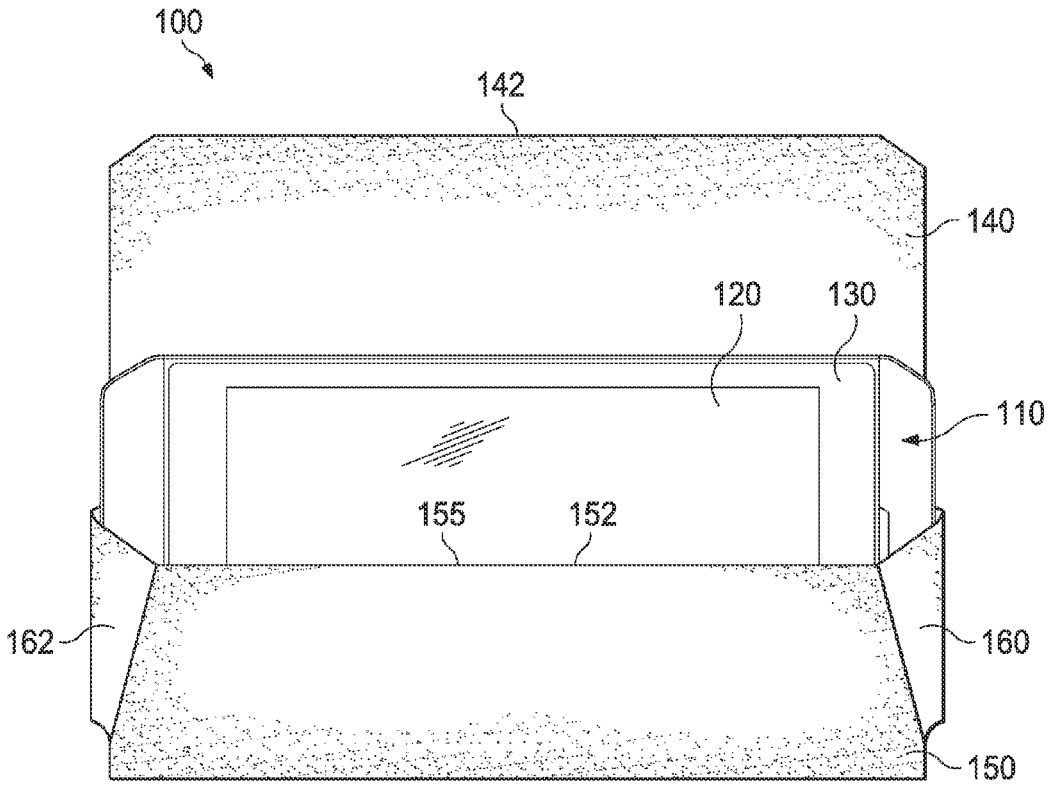
FIG. 1A is a front view of a cover for a mobile electronic device with the cover shown open and the mobile electronic device inside.
Figure 1B:
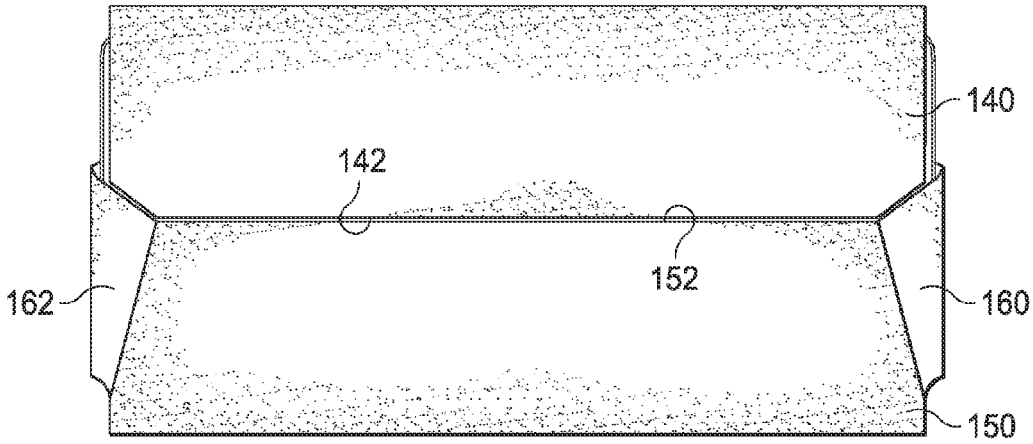
FIG. 1B is a front view of the cover shown closed.

FIG. 1A is a front view of an example cover 100 for a mobile electronic device 110 with the cover 100 shown open and the mobile electronic device 110 inside. FIG. 1B is a front view of the cover 100 shown closed. The example cover 100 is but one example of a number of different forms of covers that the concepts herein can be applied to. For example, the cover can take the form of a case, a skin, a holster, a pocket, a sleeve, a slip case, an envelope, a folio, and/or another form. As will be described in more detail below, the cover 100 defines a cavity 155 for receiving the mobile electronic device 110, and has a flap portion 140 that is changeable from open, shown in FIG. 1A, to closed, shown in FIG. 1B. The cover 100 includes a magnetic clasp that holds the flap portion 140 closed with the flap portion 140 edge to edge with another portion of the cover 100.

The mobile electronic device 110 can be hand held and can be a cellular phone, including a smart phone, a dedicated personal digital assistant (PDA) with or without phone or data capabilities, an electronic reading device, a tablet computer, a digital media player, or any other mobile device. In many instances, the terms "mobile device," "hand held device" and "hand set" are interchangeable, regarding to electronic devices available as information stores for personal contacts, calendar appointments, and the like. The mobile device can have a battery, enabling the device to be operated without a power cord. Additionally, many mobile devices wirelessly connect to the public Internet to allow for the sending and receiving of e-mail. Such mobile devices may also provide more general Internet access, such as access to the World Wide Web. For example, the mobile device 110 may be designed to operate with the General Packet Radio Service (GPRS) mobile data communication networks and may also be designed to operate with any of a variety of voice communication networks, such as AMPS, TDMA, CDMA, PCS, GSM, etc. Other types of data and voice networks, both separate and integrated, may also be utilized with the mobile device 110.

In certain instances, the mobile device 110 is a two-way RF communication device having voice and data communication capabilities. In addition, the mobile device 110 can have the capability to communicate with other mobile devices or computer systems via the Internet.

The mobile device 110 includes a front frame 130 and a screen 120. A forward facing surface of the front frame 130 forms the forward facing surface of the mobile device 110. A back cover 115 (shown in FIG. 2A) is attached to the back side of the front face and a backward facing surface of the back cover 115 defines the back surface of the mobile device 110. The front frame 130 cooperates with the back cover 115 to house inner components of the mobile device 110.

The screen 120 can be both an input device (i.e., a touch sensitive device) and an output device (i.e., a display). In some embodiments, the screen 120 is a light emitting diode (LED) backlit liquid crystal display (LCD) with multi-touch control functions. Some of these features may be omitted in other examples. For example, the screen 120 may lack the multi-touch control functions, or the screen 120 may lack the LED backlit feature. In some embodiments, the mobile device 110 may include additional features, such as a front camera.

The example cover 100 is made of a single, continuous piece of material, but could be made of multiple pieces. The material is thin and initially flat and has an edge or end surface that is perpendicular (substantially or precisely) to the plane of the material. A bottom flap portion 150 and side flap portions 160, 162 are folded together and attached to one another to define a body portion of the cover 100 having an interior cavity 155 that receives and circumscribes the mobile electronic device 110. In other instances, for example a folio cover, the side flap portions 160, 162 can be omitted. In the example cover 100, the bottom flap portion 150 has an inward facing interior surface, an outward facing exterior surface, and an end or edge surface 152 spans between the interior surface and the exterior surface (i.e., perpendicular to the plane of the material forming the bottom flap portion 150). The edge surface 152 defines a portion of the perimeter of the opening to the cavity 155.

Figure 2A:
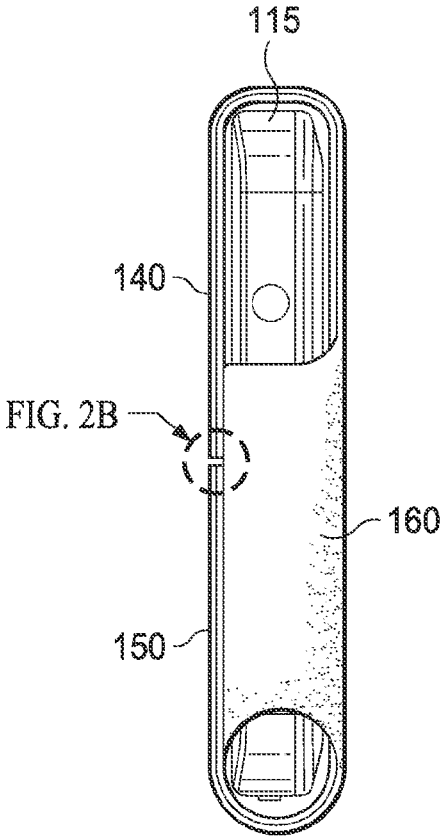
FIG. 2A is a side view of the cover of FIGS. 1A and 1B shown closed.

The top flap portion 140 is coupled to the bottom flap portion 150, and can fold from open, shown in FIG. 1A, to closed, shown in FIG. 1B. When the top flap portion 140 is open, the interior cavity 155 is open and the mobile electronic device 110 can be inserted and removed from the interior cavity 155 of the cover 100. When the top flap portion 140 is closed, it covers the opening to the cavity 155, as well as the mobile electronic device 110, and retains the mobile electronic device 110 in the interior cavity 155 of the cover 100. FIG. 2A is a side view of the cover of FIGS. 1A and 1B shown closed. As seen in FIG. 2A, the top flap portion 140 only partially covers the opening to the cavity 155 and only partially covers the mobile electronic device 110 (leaving openings on the end). In other instances, the top flap could fully cover the opening to the cavity 155 and/or the mobile electronic device 110 or could take the form of a strap that leaves an even larger portion of the opening to the interior cavity 155 uncovered. Like the bottom flap portion 150, the top flap portion 140 has an interior surface that is inward facing when the flap portion is closed, an exterior surface that is outward facing when the flap is closed, and an end or edge surface 142 (FIG. 2B) spanning between the interior surface and the exterior surface (i.e., perpendicular to the plane of the material forming the top flap portion 140). When the top flap portion 140 is closed, the edge surface 142 resides meeting the edge surface 152, adjacent to and in certain instances abutting the edge surface 152. Additionally, when the top flap portion 140 is closed, the top flap portion 140 and bottom flap portion 150 do not overlap. As seen in FIG. 2A, the exterior surface of the top flap portion 140 is flush with the exterior surface of the bottom flap portion 150 when the top flap portion 140 is closed. Such a non-overlapping edge surface to edge surface closed configuration is more compact than if the top flap portion 140 and bottom flap portion 150 were to overlap. Furthermore, because the top flap portion 140 and bottom flap portion 150 do not overlap, they do not create a pressure point on the device 110.

Figure 2B:
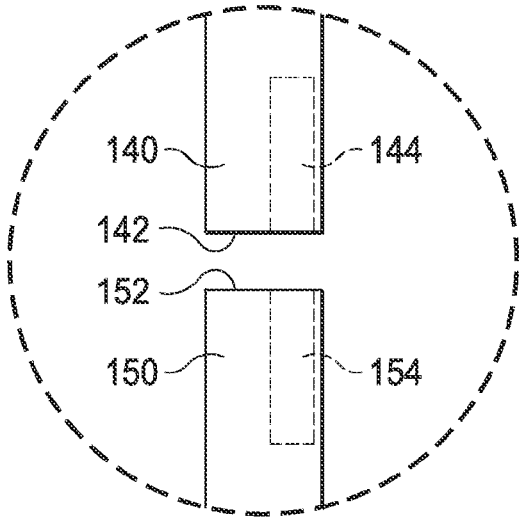
FIG. 2B is a half, side cross-sectional detail view of the cover of FIGS. 1A and 1B showing the magnetic clasp.

FIG. 2B is a half, side cross-sectional detail view of the cover of FIGS. 1A and 1B taken through the top flap portion 140 and bottom flap portion 150, intermediate the sides of the cover 100. The view shows a magnetic clasp having a first part 154 in the bottom flap portion 150 and a second part 144 in the top flap portion 140. The first part 154 magnetically clasps to the second part 144 when the edge surface 142 of the flap portion 140 is adjacent to the edge surface 152 of the bottom flap portion 150, and holds the two flap portions 140, 150 together and the top flap portion 140 closed.

Both of the magnetic clasp parts 144, 154 can include magnets (one or more magnets in each part 144, 154) with their poles aligned so that the magnets magnetically attract to one another and effectuate the clasping. Alternately, in some instances, one part (either the first part 154 in the bottom flap portion 150 or the second part 144 in the top flap portion 140) can include one or more magnets and the other part includes only ferrous metal that is magnetically attracted to the magnets. As seen in FIG. 2B, the magnetic clasp parts 144, 154 are planar (substantially or entirely), i.e. thin and flat, and embedded in the top flap portion 140 and bottom flap portion 150, respectively. Each is arranged so its edge surface coincides with an edge surface 142, 152. A portion, such as an edge surface, of the one or both magnetic clasp parts 144, 154 is exposed at the edge surface 142, 152 or the magnetic clasp parts 144, 154 are wholly embedded within the top flap portion 140 and/or bottom flap portion 150. The remainder of the magnetic clasp parts 144, 154 can be embedded in the top flap portion 140 and/or bottom flap portion 150, or other parts of the magnetic clasp parts 144, 154 can be exposed.

Figure 3:
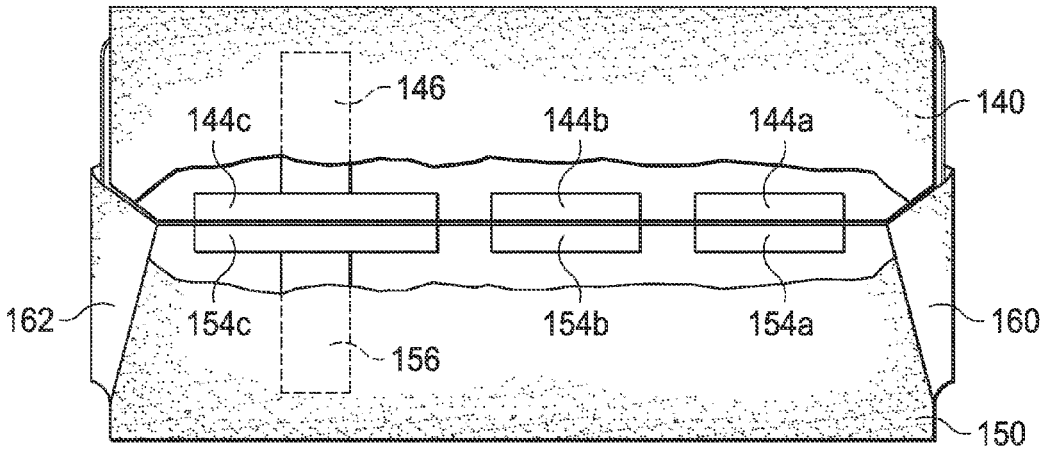
FIG. 3 is a front view of the cover of FIGS. 1A and 1B with the cover shown closed and material of the cover cut-away to show parts of the magnetic clasp.

FIG. 3 is a front view of the cover 100 cut away to show the magnetic clasp parts 144, 154. The depicted example shows three different arrangements of possible magnetic clasps. Magnetic clasp parts 144*a*, 154*a* illustrate parts that are both magnets. Magnetic clasp parts 144*b*, 154*b* illustrate parts where one part is a magnet and the other part is ferrous metal. Magnetic clasp parts 144*c*, 154*c* illustrate parts made of a ferrous metal adjacent or at the edge surface 142, 152 that is magnetized by a magnet 146, 156 adjacent and abutting the ferrous metal, but apart from the edge surface 142, 152. A given cover 100 can include one pair of magnetic clasp parts 144, 154 or multiple pairs of parts 144, 154. If the cover 100 has multiple pairs of parts 144, 154, all the pairs can be of the same arrangement, or some or all pairs can be of a different arrangement. The magnets and/or ferrous metal in the magnetic clasp parts 144, 154 can be of different shapes, including rectangular strips, square, half-moon and/or other shapes. If multiple magnetic clasps are used, all clasps can include parts 144, 154 of the same shape or some or all of the clasps can include parts 144, 154 of different shapes. Within a given magnetic clasp, the parts 144, 154 can be of the same shape or each part can be of a different configuration.

The magnets in the magnetic clasp parts 144, 154 can be magnetized with their poles on edge surfaces of the magnets, in the plane of the top flap portion 140 and bottom flap portion 150, rather than on face surfaces of the magnets, perpendicular to the plane of the top flap portion 140 and bottom flap portion 150. With the poles on the edge surfaces of the magnets, the poles are aligned when the top flap portion 140 is closed, and the resulting magnetic attraction (whether both magnetic clasp parts 144, 154 are magnets or one is a ferrous metal) is greater than if the poles of the magnets were in the face surfaces of the magnets. Additionally, because the face surface Gauss on such magnets is lower than if the poles were on the face surfaces, there is less need to shield the magnets from the device 110. For example, in certain instances, the thickness of any shield can be reduced over that needed for magnets with face poles or, in certain instances, the shield may be omitted. The configurations of magnetic clasp parts 144, 154 with a magnet adjacent or abutting a ferrous metal can likewise have poles on the edges surfaces of the magnets that are adjacent or abutting the ferrous metal.

Figure 4:
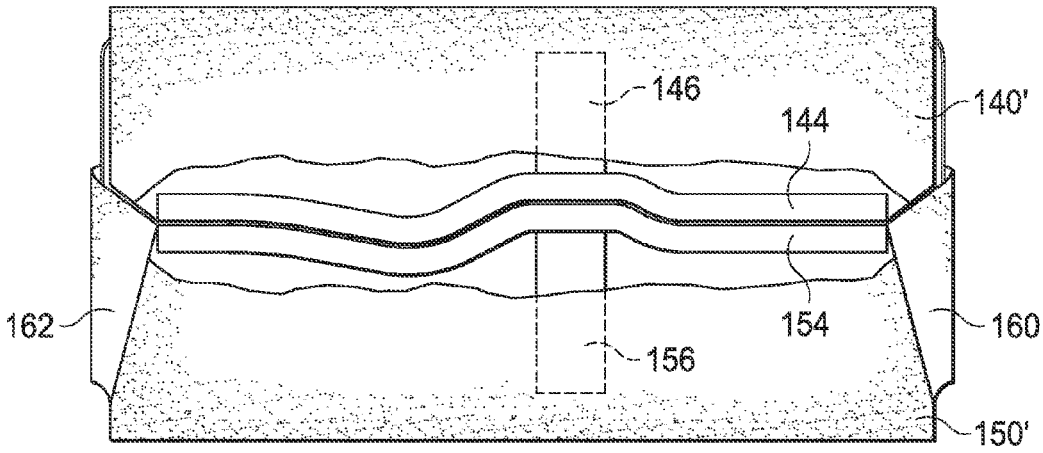
FIG. 4 is a front view of yet another cover for a mobile electronic device with the cover shown closed and material of the cover cut-away to show parts of the magnetic clasp.

The edge surface 142 of the top flap portion 140 and the edge surface 152 of the bottom flap portion 150 need not be straight as in FIGS. 1-3. FIG. 4 is a front view of yet another cover for a mobile electronic device with the cover shown closed. In this view, the edge surfaces 142, 152 have an interlocking non-straight shape, where the bottom flap portion 150 protrudes into a recessed area of the top flap portion 140. The non-straight shape can be configured to facilitate alignment of the top flap portion 140 with the bottom flap portion 150 when the cover is closed. While such instances can use any configuration of magnetic clasp described above, if the magnetic clasp parts 144, 154 include a ferrous metal abutting a magnet, the ferrous metal can conform to the non-straight shape of the edge surfaces 142, 152. Furthermore, in certain instances, the ferrous metal can extend the length (partially, substantially or entirely) of the edge surfaces 142, 152. Because ferrous metal is malleable, it will be less prone to breaking than a (more brittle) magnet of the same size.

Of note, although the concepts herein have been described with respect to a cover having a top flap portion that is clasped to a bottom flap portion, the concepts are applicable to many other configurations. For example, the concepts could be applied to side flaps, pockets, accessory loops and/or other aspects of a mobile electronic device cover.

As is apparent from the discussion above, the concepts herein encompass a cover for a mobile electronic device that has a flap or flaps that, when closed, meet edge surface to edge surface with an edge surface of another flap or another part of the cover. The edge surfaces each contain a part of a magnetic clasp to clasp the edge surfaces together, and the flap or flaps closed. Such a configuration is more compact than configurations having flaps that overlap another part of the cover, and additionally do not create a pressure point that may bear on the device.

A number of variations have been described. Nevertheless, it will be understood that various modifications may be made. Accordingly, other variations are within the scope of the following claims.

What is claimed is:

1. A cover for a mobile electronic device, comprising:

a body portion defining an interior cavity for receiving the mobile electronic device, the body portion around an opening to the cavity having an inward facing interior surface, an outward facing exterior surface and an edge surface spanning between the interior surface and the exterior surface;

a planar flap portion coupled to the body portion and closeable to at least partially cover the opening to the cavity, the planar flap portion having an interior surface that is inward facing when the planar flap portion is closed, an exterior surface that is outward facing when the planar flap portion is closed, and an edge surface spanning between the interior surface and the exterior surface, and the edge surface of the planar flap portion meeting the edge surface of the body portion when the planar flap portion is closed, where the exterior surface of the planar flap portion is flush with the exterior surface of the body portion when the planar flap portion is closed; and a magnetic clasp having a first part in the body portion that magnetically clasps to a second part of the magnetic clasp in the planar flap portion when the edge surface of the planar flap portion is meeting the edge surface of the body portion.

2. The cover of claim 1, where the planar flap portion does not overlap the body portion when the flap portion is closed.

3. The cover of claim 1, where at least one of the first part or the second part comprises a magnet having a pole at an edge surface of the magnet, the edge surface of the magnet is adjacent the edge surface of the body portion or the planar flap portion.

4. The cover of claim 3, where the magnet is planar and embedded within the body portion or the planar flap portion.

5. The cover of claim 3, where at least one of the first part or the second part comprises a ferrous metal.

6. The cover of claim 1, where at least one of the first part or the second part comprises:

a ferrous metal adjacent the edge surface of the body portion or the planar flap portion; and a magnet adjacent the ferrous metal.

7. The cover of claim 6, where the magnet has a polarized edge surface abutting the ferrous metal.

8. The cover of claim 6, where the ferrous metal extends substantially an entire length of the edge surface of the planar flap portion residing adjacent the edge surface of the body portion when the planar flap portion is closed.

9. The cover of claim 1, where the edge surface of the planar flap portion has an interlocking shape with the edge surface of the body portion.

10. The cover of claim 1, where the cavity is configured to circumscribe the mobile electronic device.

11. The cover for a mobile electronic device of claim 1, wherein the edge surface of the planar flap portion has a first dimension, the edge surface of the body portion has a second dimension, and wherein the first dimension and the second dimension are the same.

12. The cover for a mobile electronic device of claim 1, wherein the exterior surface of the body portion has a first area and the edge surface has a second area that is smaller than the first area.

13. The cover for a mobile electronic device of claim 1, wherein the flap portion includes an open position and a closed position, and wherein the edge surface of the planar flap portion directly faces the edge surface of the body portion with the planar flap portion being in the closed position.

14. A method, comprising:

wherein a mobile electronic device cover receives a mobile electronic device; and magnetically clasping an edge surface of a planar flap portion of the cover to an edge surface of another part of the cover with the edge surfaces meeting, where the planar flap portion is flush with the another part of the cover, where magnetically clasping an edge surface of the planar flap portion of the cover to an edge surface of the another part of the cover with the edge surfaces meeting, comprises magnetically clasping the edge surface of the planar flap portion of the cover to the edge surface of the another part of the cover with the edge surfaces abutting and not overlapping.

15. The method of claim 14, where magnetically clasping comprises magnetically attracting a first part of a magnetic clasp with a second part of the magnetic clasp when a pole of the first part of the magnetic clasp is aligned with an opposing pole of the second part of the magnetic clasp.

16. A mobile electronic device cover, comprising:

a first cover portion having a first edge surface along a perimeter thereof;

a second cover portion having a second edge surface along a perimeter thereof; and a magnetic clasp having a first part in the first cover portion adjacent the first edge surface and a second part in the second cover portion adjacent the second edge surface and adapted to magnetically hold the first edge surface meeting the second edge surface, where one or both of the first cover portion and the second cover portion is planar and the first cover portion is flush with the second cover portion when the first edge surface meets the second edge surface, and where the magnetic clasp is adapted to magnetically hold the first edge surface meeting the second edge surface with the first cover portion and the second cover portion are not overlapping.

17. The mobile electronic device cover of claim 16, where the first part comprises:

a ferrous metal adjacent the edge surface of the first cover portion; and a magnet abutting the ferrous metal.

18. The mobile electronic device cover of claim 17, where the ferrous metal extends substantially an entire length of the edge surface of the first cover portion.

19. The mobile electronic device cover of claim 16, where the edge surface of the first cover portion has an interlocking shape with the edge surface of the second cover portion.

20. The mobile electronic device cover of claim 16, where the magnetic clasp comprises at least one magnet that is planar and embedded within the first cover portion or the second cover portion.

21. The mobile electronic device cover of claim 16, wherein the first cover portion includes a first outer surface, the second cover portion includes a second outer surface, and the first outer surface and the second outer surface are essentially co-planar with the first edge surface meeting the second edge surface.

22. The mobile electronic device cover of claim 16, wherein the first edge surface has a same height as the second edge surface.

* * * * *

UNITED STATES PATENT AND TRADEMARK OFFICE

CERTIFICATE OF CORRECTION

PATENT NO. : 8,662,298 B2
APPLICATION NO. : 13/404326
DATED : March 4, 2014
INVENTOR(S) : Leonardo Aldana and Felipe Oliveira Simoes It is certified that error appears in the above-identified patent and that said Letters Patent is hereby corrected as shown below:

On the Title Page, Item (54) and in the Specification, in Column 1, in Line 1, delete "MAGNETIC".

Signed and Sealed this
Sixteenth Day of September, 2014

Michelle K. Lee

Michelle K. Lee
*Deputy Director of the United States Patent and Trademark Office*